US008033432B2

(12) United States Patent
Pardonge et al.

(10) Patent No.: US 8,033,432 B2
(45) Date of Patent: Oct. 11, 2011

(54) DISTRIBUTION DEVICE FOR FLUID PRODUCT

(75) Inventors: Jean-Marc Pardonge, Les Authieux sur Port Saint-Ouen (FR); Jacques Fontela, Vitot (FR)

(73) Assignee: Valois SAS, Le Neubourg (FR)

( * ) Notice: Subject to any disclaimer, the term of this patent is extended or adjusted under 35 U.S.C. 154(b) by 1147 days.

(21) Appl. No.: 10/549,168

(22) PCT Filed: Mar. 11, 2004

(86) PCT No.: PCT/FR2004/000582
§ 371 (c)(1),
(2), (4) Date: Jul. 7, 2006

(87) PCT Pub. No.: WO2004/083045
PCT Pub. Date: Sep. 30, 2004

(65) Prior Publication Data

US 2006/0249543 A1 Nov. 9, 2006

(30) Foreign Application Priority Data

Mar. 13, 2003 (FR) ..... 03 03136

(51) Int. Cl.
*B65D 83/00* (2006.01)

(52) U.S. Cl. ..... 222/402.2; 222/402.1; 222/394

(58) Field of Classification Search ..... 222/402.1, 222/402.2, 394
See application file for complete search history.

(56) References Cited

U.S. PATENT DOCUMENTS

| | | | | |
|---|---|---|---|---|
| 27,146 | A * | 8/1860 | de LaForcade et al. | 110/234 |
| 2,686,081 | A * | 8/1954 | Cooksley | 239/337 |
| 2,835,418 | A * | 5/1958 | Manetti | 222/402.24 |
| 2,862,648 | A * | 12/1958 | Cooksley et al. | 222/402.24 |
| 2,863,699 | A * | 12/1958 | Elser | 222/402.24 |
| 3,107,829 | A * | 10/1963 | Makowski | 222/525 |
| 3,435,998 | A * | 4/1969 | Kahn | 222/402.24 |
| 3,539,083 | A * | 11/1970 | Mason et al. | 222/402.24 |
| 4,251,032 | A * | 2/1981 | Werding | 239/323 |
| 4,607,765 | A * | 8/1986 | Ruscitti | 222/321.9 |
| 5,083,685 | A * | 1/1992 | Amemiya et al. | 222/402.1 |
| 5,100,027 | A * | 3/1992 | Gueret | 222/105 |
| 5,419,463 | A * | 5/1995 | Mizushima et al. | 222/321.3 |
| 5,443,783 | A | 8/1995 | Shepherd et al. | |
| 5,623,974 | A * | 4/1997 | Losenno et al. | 141/20 |
| 5,975,356 | A * | 11/1999 | Yquel et al. | 222/54 |
| 6,244,475 | B1 | 6/2001 | Walz et al. | |
| 6,345,740 | B1 * | 2/2002 | Riebe | 222/402.1 |
| 6,527,150 | B2 * | 3/2003 | Benoist | 222/402.1 |
| 7,105,106 | B2 * | 9/2006 | Samuels et al. | 252/299.01 |

(Continued)

FOREIGN PATENT DOCUMENTS

EP 1048454 A1 11/2000

(Continued)

*Primary Examiner* — Frederick C Nicolas
*Assistant Examiner* — Donnell Long
(74) *Attorney, Agent, or Firm* — Sughrue Mion, PLLC

(57) ABSTRACT

The invention relates to a distribution device for fluid product, comprising a reservoir (1), containing the fluid product and a propellant gas, a valve (10), with a valve body (11) and a throttle valve (12), sliding within said valve body (11), between a rest position and a distribution position. Said reservoir (1) is rigid and made from a high-performance synthetic material resistant to the pressure of the propellant gas, sad material having a low permeability to water and oxygen.

13 Claims, 3 Drawing Sheets

U.S. PATENT DOCUMENTS

| | | | | |
|---|---|---|---|---|
| 7,267,120 | B2 * | 9/2007 | Rustad et al. | 128/200.18 |
| 2001/0050291 | A1 * | 12/2001 | Jud et al. | 222/107 |
| 2003/0015191 | A1 * | 1/2003 | Armstrong et al. | 128/200.21 |
| 2004/0074904 | A1 * | 4/2004 | Share et al. | 220/62.22 |

FOREIGN PATENT DOCUMENTS

| | | | |
|---|---|---|---|
| GB | 1007493 | | 10/1965 |
| GB | 2377694 | A | 1/2003 |
| JP | 1-99452 | U | 7/1989 |
| JP | 2214555 | * | 8/1990 |
| JP | 05-026395 | A | 2/1993 |
| JP | 2001-506211 | A | 5/2001 |
| WO | 99/00315 | A1 | 1/1999 |
| WO | WO 00/38917 | A1 | 7/2000 |

* cited by examiner

DISTRIBUTION DEVICE FOR FLUID PRODUCT

BACKGROUND OF THE INVENTION

1. Field of the Invention

The present invention relates to a distribution device for fluid product, and more specifically to an aerosol type device for distributing a fluid product by means of propellant gas.

2. Description of the Related Art

Aerosol devices generally include a reservoir or can, made in metal, notably in aluminium. A valve, which may be a metering valve, is attached, generally crimped on the neck of the reservoir by means of an attachment ring or capsule, in this case a crimping ring. The reservoir contains a fluid product and a propellant gas, notably liquefied gas, so that the contents of the reservoir is pressurized. When the user actuates the valve, expansion of the propellant gas causes the product to be expelled through said valve. The metal and more particularly the aluminium reservoirs have a certain number of drawbacks. It is difficult or even impossible to produce complex shapes of reservoirs at reasonable costs, on the one hand. Moreover, the use of metal should be considered as undesirable from an ecological point of view. The machines for manufacturing and assembling such aluminium reservoirs are also complicated and costly.

BRIEF SUMMARY OF THE PREFERRED EMBODIMENTS

The object of the present invention is to provide a distribution device for a fluid product which does not reproduce the aforementioned drawbacks.

More particularly, the object of the present invention is to provide such a device which guarantees the seal and the strength of the reservoir while limiting to the utmost, harmful interactions with the fluid product.

The object of the present invention is also to provide such a device with which any desired shapes may be produced for the reservoir.

The object of the present invention is also to provide such a device which is simple and not very costly to manufacture and assemble.

The object of the present invention is also to provide such a device which limits to the utmost, the use of metal, notably of aluminium.

Therefore the object of the present invention is a distribution device for fluid product, including a reservoir, containing the fluid product and a propellant gas, and a valve, including a valve body and a valve stem sliding within said valve body between a rest position and a distribution position, said reservoir being rigid and made from a high performance synthetic material resistant to the pressure of the propellant gas, said material having a low permeability to water and gases.

Advantageously, the reservoir is made by moulding.

Advantageously, said reservoir is made in a one-piece part with said valve body.

Advantageously, said synthetic material has high tensile and flexural moduluses and/or high shock resistance.

Advantageously, said synthetic material has a low linear expansion coefficient.

Advantageously, the temperature of the mould during the moulding of said synthetic material is less than 100° C.

Advantageously, said synthetic material has a permeability to oxygen less than 10 $cm^3/m^2/day$, preferably less than 1 $cm^3/m^2/day$, and a permeability to water less than 10 $g/m^2/day$, preferably less than 1 $g/m^2/day$, at a pressure of 1 bar for a thickness of 25 μm.

Advantageously, said synthetic material has tensile and flexural moduluses larger than 5,000 MPa, preferably larger than 10,000 MPa.

Advantageously, said synthetic material comprises LCP (Liquid Crystal Polymer).

Advantageously, said synthetic material comprises one or more of the following components: PEN (polyethylene naphthalate), POM (polyoxymethylene), PSU (polysulfone), PEEK (polyetherether ketone), PEK (polyether ketone), PAEK (polyarylether ketone), PPE (polyphenylether), PEI (polyether imide), PA 4,6 (polyamide 4,6), PA FV (polyamides with glass fibers), PPS (polyphenylene sulphide).

Advantageously, said fluid product is a pharmaceutical product.

Advantageously, said propellant gas comprises HFA-134a or HFA-227 gases, with or without alcohol.

BRIEF DESCRIPTION OF THE DRAWINGS

Other features and advantages of the present invention will become more clearly apparent during the following detailed description of a particular embodiment thereof, made with reference to the appended drawings, given as non-limiting examples, and wherein.

DETAILED DESCRIPTION OF THE PREFERRED EMBODIMENTS

The present invention is applied to any type of distribution device for a fluid product in which a propellant gas is used for performing the distribution. The examples hereafter include metering valves, i.e., valves distributing an accurate and reproducible dose, at each actuation of the device, but it is understood that the present invention is not limited to this type of valve.

Figure 1:
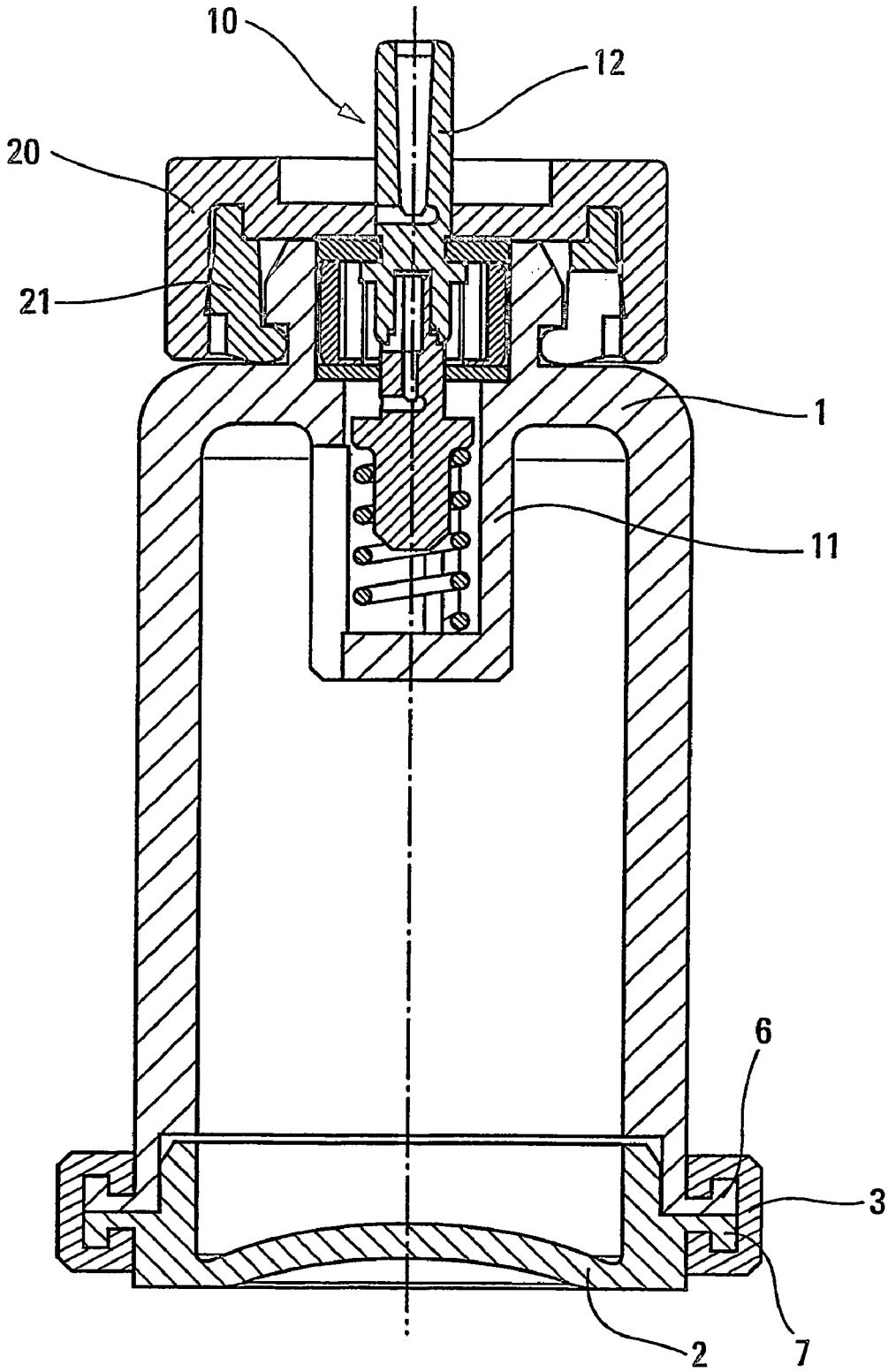
FIG. 1 is a schematic cross-sectional view of a distribution device according to a particular embodiment of the present invention.
Figure 2:
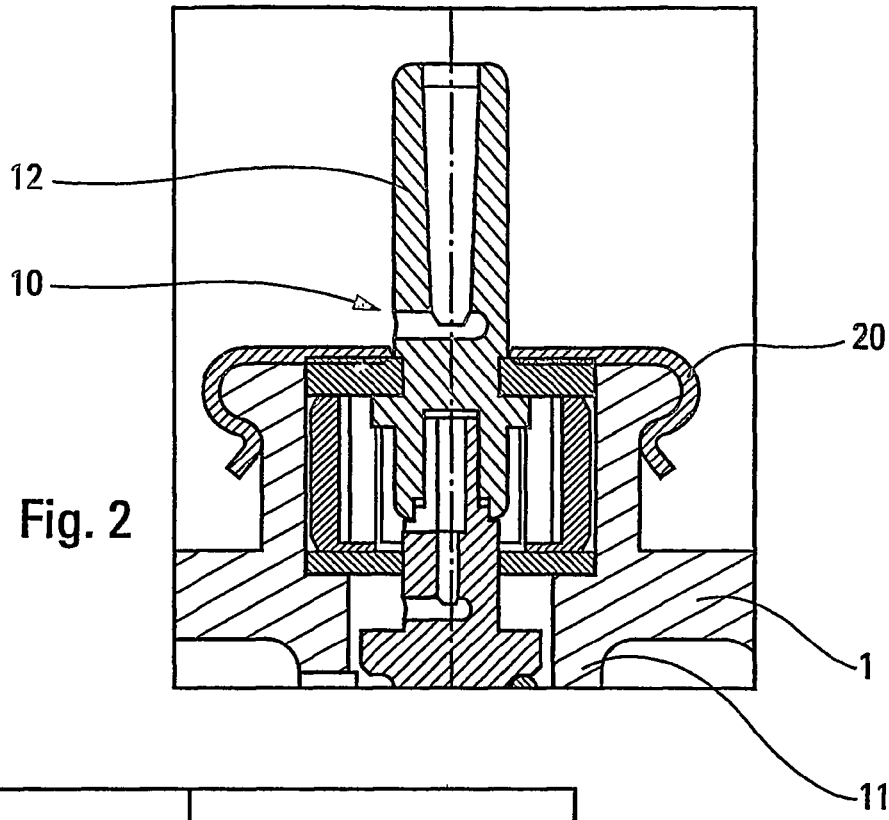
FIGS. 2 and 3 are partial views showing two alternative embodiments of the upper portion of a distribution device according to the present invention.
Figure 3:
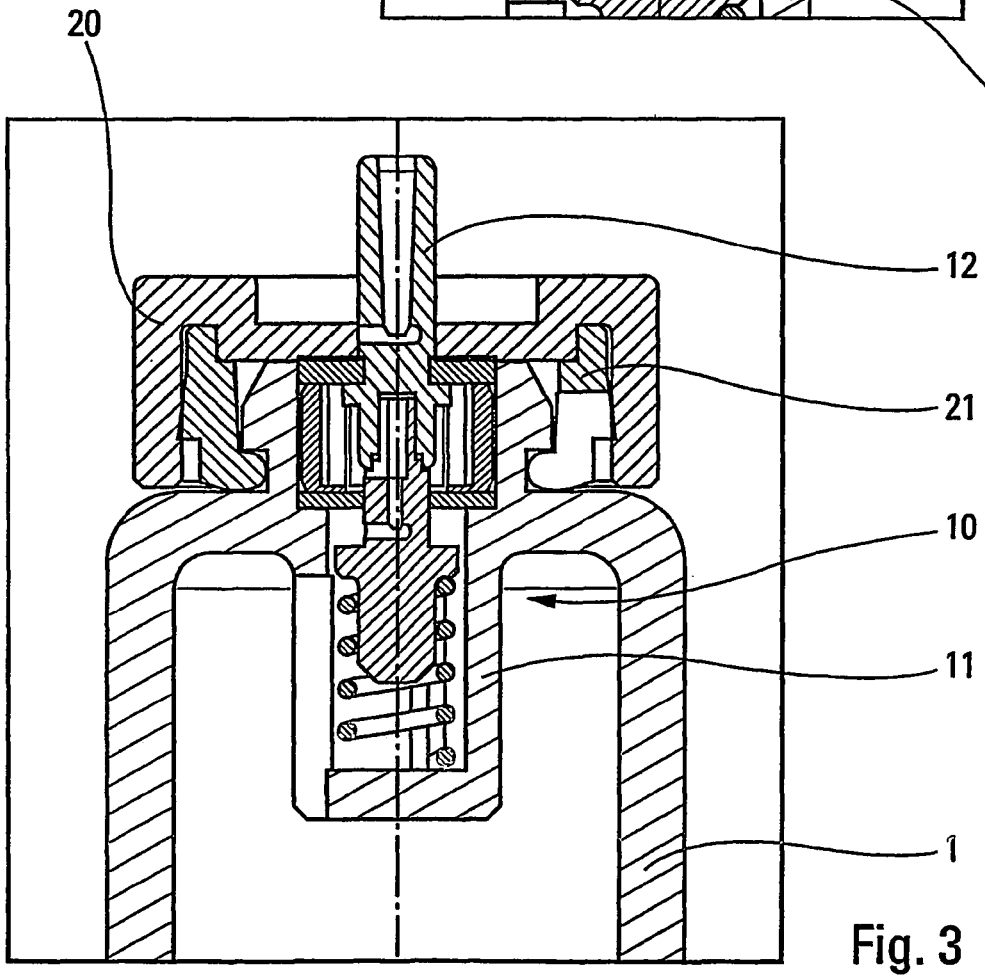

With reference to the figures, the device includes a reservoir 1 containing the fluid product and a liquefied propellant gas. By fluid product, it is meant any liquid, pasty, gaseous, or powdery product, which may be associated in any way with a propellant gas for its expulsion. A valve 10, including a valve body 11, is provided for performing the distribution of the contents of the reservoir, said valve able to be assembled on the reservoir 1 by means of an attachment ring or capsule 20, which, in the example of FIG. 2 is a crimpable capsule, whereas in the example of FIGS. 1 and 3, this is a snap-on ring including specific snap-on means 21. Of course, any type of attachment ring or capsule 20 may be associated with the present invention.

Advantageously, the bottom 2 of the reservoir may be sealably attached to the reservoir 1 by overinjection. Preferably, the bottom 2 and the overinjected material 3 are formed with the same material as the reservoir 1. Of course, the attachment and the seal should resist to the pressure inside the reservoir 1.

Figure 4:
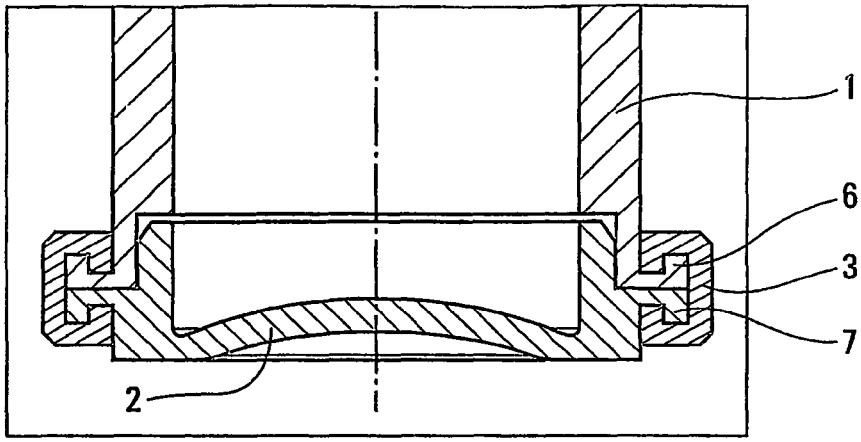
FIGS. 4 to 7 are partial views showing four alternative embodiments of the lower portion of a distribution device according to the present invention.
Figure 5:
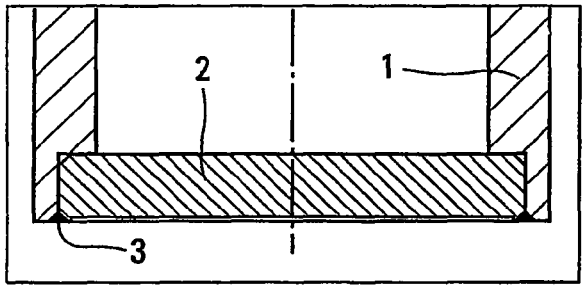
Figure 6:
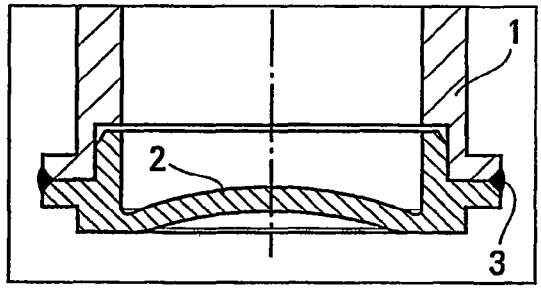
Figure 7:
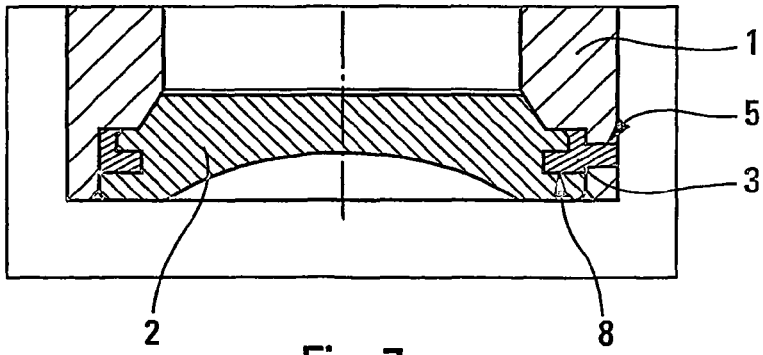

FIGS. 4 to 7 illustrate different alternative embodiments. FIG. 4, like FIG. 1, shows an attachment part 3 overinjected onto radial ribs 6 and 7, integral with the reservoir 1 and the bottom 2, respectively. FIGS. 5 and 6 show two alternatives in which the attachment and seal are provided by the intimate connection similar to an adhesive bond, obtained during overinjection of the material 3. FIG. 7 shows a particularly solid attachment in which the reservoir 1 includes several windows 5 and the bottom 2 includes a groove 8, or the like, the injected material 3 filling said window 5 and said groove 8, in order to provide the attachment and seal.

The valve 10 includes a valve body 11 in which a valve stem 12 sealably slides between a rest position, illustrated in the figures, and a distribution position, in which the valve stem is pushed into the inside of the valve body to allow the product to be expelled.

According to the invention, the reservoir is made in a high performance synthetic material. This synthetic material should resist to the pressure of the propellant gas and should therefore have suitable properties. In particular, it preferably has a low permeability to water and to gases, notably to oxygen, a high shock resistance and high tensile and flexural moduluses, so that this material is particularly rigid. With the material rigidity characteristics, it is thereby possible to avoid the use of metal in the making of the reservoir. Also, it is no longer necessary to provide a synthetic material coating generally covering the metal reservoirs, intended to prevent any interference between the product contained in the reservoir and the metal surfaces of the reservoir. Advantageously, this material also has a low linear expansion coefficient, which further improves its capability of being used with pressurized reservoirs. Advantageously, the synthetic material has a permeability to oxygen less than 10 $cm^3/m^2$/day, with reference to a pressure of 1 bar, a wall thickness of 25 μm, a temperature of 23° C. and 0% relative humidity. Preferably, this permeability is even less than 1 $cm^3/m^2$/day. Also, the synthetic material advantageously has a permeability to water less to 10 $g/m^2$/day, preferably less than 1 $g/m^2$/day, with reference to a pressure of 1 bar, a wall thickness of 25 μm, a temperature of 38° C. and 90% relative humidity. Table 1 shows that LCP (Liquid Crystal Polymer) has excellent permeability properties.

TABLE 1

| | LCP | Poly-propylene | Polyamide 6 |
|---|---|---|---|
| Permeability to oxygen in $cm^3/m^2$/day, 1 bar, 25 μm, 23° C., 0% | 0.9 | >2,000 | >75 |
| Permeability to water in $cm^3/m^2$/day, 1 bar, 25 μm, 38° C., 90% | 0.3 | 7 | >300 |

The tensile and flexural moduluses of the synthetic material advantageously are larger than 5,000 MPa, preferably larger than 10,000 MPa.

Table 2 has a certain number of high performance synthetic materials, the properties of which are compared with aluminium.

TABLE 2

| | Aluminium | LCP (Liquid crystal polymer) | Poly-propylene | Polyamide 6 |
|---|---|---|---|---|
| Tensile modulus (MPa) | 70,000 | 15,000 | 1,000-1,500 | 3000 |
| Flexural modulus (MPa) | 70,000 | 15,000 | 1,300 | 2,500 |
| | POM (polyoxy-methylene) | PSU (polysulfone) | PEI (polyether imide) | PA 4,6 (polyamide 4,6) |
| Tensile modulus (MPa) | 3,000 | 3,000 | 3,000 | 3,300 |
| Flexural modulus (MPa) | 2,500 | 3,000 | 3,000 | 3,300 |
| | PA FV (polyamides glass fibers) | PPS + glass fiber (polyphenylene sulfide) | PPE + glass fiber (polyphenyl-ether) | PEEK + glass fiber (polyether-ether ketone) |
| Tensile modulus (MPa) | 11,000 | 15,000 | 9,000 | 10,000 |
| Flexural modulus (MPa) | 8,500 | 15,000 | 9,000 | 10,000 |

Table 2 clearly shows that different synthetic materials may be used for achieving the present invention. However, it appears that LCP (Liquid Crystal Polymer) has the best characteristics. Indeed, it meets the requirements in an optimum way for all the required properties (permeability, rigidity, shock resistance). It further has a significant advantage over most of the other materials shown in this Table, i.e., that the temperature of the mould during the moulding of LCP is generally below 100° C., whereas the other materials require a mould temperature above 150° C. With this, it is possible to carry out the manufacturing of the reservoir at a minimum cost, without having to use moulds operating at a very high temperature, which are complicated and costly to manufacture and to use.

The other synthetic materials of table 2 might also be used, either alone or as a mixture, according to the requirements related to the fluid product and/or to the propellant gas. PEN (polyethylene naphthalate) may also be contemplated.

However, these materials have characteristics inferior to those of LCP as regards permeability to water and to oxygen, LCP therefore being the preferred material for achieving the present invention.

It should be noted that the synthetic materials usually used for manufacturing the reservoirs or cans of distribution devices for fluid product are not suitable for making reservoirs of aerosol devices because of the pressure. Thus, for example, polyolefin, polypropylene, certain polyesters, polyacetal, polystyrene, or certain polyamides have pressure resistance problems and/or insufficient mechanical properties and/or unacceptable permeabilities. Therefore, these materials are not suitable for use within the scope of reservoirs of distribution devices for fluid product containing a propellant gas. Certain of these materials also react unfavourably with solvents and/or propellant gases, so that they are not suited for distributing pharmaceutical products.

Advantageously, as illustrated in the figures, the reservoir 1 and the valve body 11 are made as a single one-piece part. Preferably, this assembly is made by moulding from a high performance synthetic material such as described above. Of course, this cannot be achieved with reservoirs made in metal, and notably in aluminium, and by using high performance synthetic materials, it is therefore possible not only to make the valve body and the reservoir in a single piece, but also to achieve the desired shapes for the reservoir, the moulding of a synthetic material not posing any problem. This particularly advantageous embodiment of a valve body and of a one-piece reservoir fully participate in a goal strived by the invention, which aims at simplifying manufacture as well as assembly of the device to reduce its manufacturing costs.

A particular use of the device of the present invention relates to the distribution of pharmaceutical product. Also at this level, the synthetic material should have satisfactory properties as regards the interaction between the synthetic material and the drug contained in the reservoir. Again, for this property, LCP has optimal characteristics so that it is particularly suited for use within the scope of the present invention. The preferred propellant gases are gases of the HFA-134a or HFA-227 type, with or without alcohol, which are not harmful for the environment. However the use of these propellant gases increases the pressure inside the reservoir as compared with the earlier propellant gases (CFC gases), which are now prohibited for reasons related to protection of the environment. Synthetic materials which would have proved to be satisfactory with CFC gases can no longer be used with HFA gases, in particular with HFA-134a, and the present invention provides a solution to this problem, in particular when the material used is LCP.

The present invention was described with reference to a particular example, but it is understood that any change may be made to it by the skilled practitioner without departing from the scope of the present invention as defined by the appended claims.

The invention claimed is:

1. A distribution device for fluid product, including a reservoir (1), containing the fluid product and a propellant gas, and a valve (10), including a valve body (11) and a valve stem (12) sliding in said valve body (11) between a rest position and a distribution position, wherein said reservoir (1) is made from a one-piece part with said valve body (11), said reservoir (1) and said valve body (11) being rigid and made from a high performance synthetic material resistant to the pressure of the propellant gas, said material having a low permeability to water and to gases;

wherein said synthetic material has a permeability to oxygen less than 10 $cm^3/m^2$/day and a permeability to water less than 10 $g/m^2$/day at a pressure of 1 bar for a thickness of 25 μm;

wherein said synthetic material comprises LCP (Liquid Crystal Polymer); and wherein said propellant gas comprises HFA-134a or HFA-227 gases, with or without alcohol.

2. The device according to claim 1, wherein the reservoir (1) is made by moulding.

3. The device according to claim 1, wherein the reservoir (1) includes a bottom (2) sealably attached to the reservoir (1) by overinjection.

4. The device according to claim 1, wherein said synthetic material has high tensile and flexural moduluses and/or high shock resistance.

5. The device according to claim 1, wherein the synthetic material has a low linear expansion coefficient.

6. The device according to claim 1, wherein the temperature of the mould during the moulding of said synthetic material is below 100° C.

7. The device according to claim 1, wherein said synthetic material has a permeability to oxygen less than 1 $cm^3/m^2$/day, and a permeability to water less than 1 $g/m^2$/day, at a pressure of 1 bar for a thickness of 25 μm.

8. The device according to claim 1, wherein said synthetic material has tensile and flexural moduluses larger than 5,000 MPa, preferably larger than 10,000 MPa.

9. The device according to claim 1, wherein said synthetic material comprises one or more of the following components: PEN (polyethylene naphthalate), POM (polyoxymethylene), PSU (polysulfone), PEEK (polyetherether ketone), PEK (polyether ketone), PAEK (polyarylether ketone), PPE (polyphenylether), PEI (polyether imide), PA 4,6 (polyamide 4,6), PA FV (polyamides with glass fibers), PPS (polyphenylene sulphide).

10. The device according to claim 1, wherein said fluid product is a pharmaceutical product.

11. A distribution device for a fluid comprising:

a propellant gas comprising either HFA-134a gas or HFA-227 gas, with or without alcohol;

a reservoir comprising a Liquid Crystal Polymer, wherein the reservoir is configured to contain the fluid and the propellant gas;

a valve comprising a valve body and a valve stem, wherein the valve stem is configured to slide in the valve body between a rest position and a distribution position, and wherein the valve body comprises a Liquid Crystal Polymer;

wherein the reservoir and the valve body have an oxygen permeability of less than 10 $cm^3/m^2$/day and a water permeability of less than 10 $g/m^2$/day at a pressure of 1 bar across a wall thickness of 25 μm;

wherein the reservoir and the valve body are integrally formed as a one-piece part.

12. The device according to claim 1, wherein the valve body houses a spring for biasing the valve stem into the rest position.

13. The device according to claim 11, wherein the valve body houses a spring for biasing the valve stem into the rest position.

* * * * *